US012434106B2

(12) United States Patent
Ratigan et al.

(10) Patent No.: US 12,434,106 B2
(45) Date of Patent: Oct. 7, 2025

(54) EDGE PROTECTOR MAT

(71) Applicants: Edward Ratigan, Graham, NC (US); Michael Ratigan, Elon, NC (US)

(72) Inventors: Edward Ratigan, Graham, NC (US); Michael Ratigan, Elon, NC (US)

(73) Assignee: Fjord, Inc., Graham, NC (US)

( * ) Notice: Subject to any disclaimer, the term of this patent is extended or adjusted under 35 U.S.C. 154(b) by 1162 days.

(21) Appl. No.: 17/338,132

(22) Filed: Jun. 3, 2021

(65) Prior Publication Data

US 2022/0387856 A1 Dec. 8, 2022

(51) Int. Cl.
*A63B 29/02* (2006.01)

(52) U.S. Cl.
CPC ..... *A63B 29/02* (2013.01)

(58) Field of Classification Search
CPC ..... A63B 27/00; A63B 29/02; B25H 3/006; A01K 97/08; B66D 3/04; A62B 1/18; A62B 1/06; A62B 1/20; F16L 57/06; A45C 2007/0004; B65H 57/04; B65H 57/06; B65H 57/12; B65H 57/14; B65H 57/16; B65H 57/26
See application file for complete search history.

(56) References Cited

U.S. PATENT DOCUMENTS 3,575,327 A * 4/1971 Harrison ..... A01K 97/08 294/157
4,402,489 A 9/1983 Murray
4,483,380 A * 11/1984 Beran ..... A45C 3/00 206/523
4,489,815 A * 12/1984 Martinez ..... A45F 4/02 229/189
4,869,466 A * 9/1989 Isenhart ..... A62B 1/18 254/394
4,874,095 A * 10/1989 Warych ..... B65D 71/04 264/177.1

(Continued)

FOREIGN PATENT DOCUMENTS

GB 2135267 8/1984
GB 2135267 A * 8/1984 ..... A63B 29/02
WO WO-2008069672 A2 * 6/2008 ..... A45C 13/30

OTHER PUBLICATIONS

Webpage printout showing Ultra-Pro™ Edge Protectors as sold by CMC Pro, print date Jul. 30, 2020.

(Continued)

*Primary Examiner* — Kyle J. Walraed-Sullivan
(74) *Attorney, Agent, or Firm* — Tuggle Duggins P.A.; Blake P. Hurt

(57) ABSTRACT

An edge protector mat is formed from a mat with a top surface, a bottom surface, and a number of metal bars. The top surface contains a number of receptacles grouped into one or more pairs sized, shaped, and otherwise configured to receive opposing ends of the metal bars therein. Each of the metal bars define opposing ends, different ones of which are positioned within corresponding ones of the pair of the receptacles of the top surface. The metal bars are configured to prevent friction from being imparted onto the mat. At least one pair of the receptacles are positioned opposite one another on the mat allowing receipt of different portions of at least one of the metal bars.

18 Claims, 8 Drawing Sheets

(56) References Cited

U.S. PATENT DOCUMENTS

| | | | | |
|---|---|---|---|---|
| 5,901,756 | A * | 5/1999 | Goodrich | F16L 3/233 248/205.2 |
| 7,311,483 | B1 * | 12/2007 | Nudo | B60P 7/0869 410/99 |
| 7,481,234 | B1 | 1/2009 | Gustafson et al. | |
| 10,213,649 | B2 | 2/2019 | Norton | |
| 10,524,560 | B2 | 1/2020 | Hanson et al. | |
| 10,639,782 | B1 * | 5/2020 | Michuta | B25H 3/006 |
| 11,219,800 | B1 * | 1/2022 | Ratigan | A63B 29/02 |
| 2012/0037527 | A1 * | 2/2012 | Fay | A62B 1/14 206/372 |
| 2013/0032557 | A1 * | 2/2013 | Porath | A45C 9/00 211/85.7 |
| 2020/0315384 | A1 * | 10/2020 | Patel | A45C 9/00 |
| 2022/0192334 | A1 * | 6/2022 | Ratigan | A45F 4/02 |
| 2022/0306421 | A1 * | 9/2022 | Dorenbos | B65H 57/02 |

OTHER PUBLICATIONS

Webpage printout from Amazon showing P68 Set Caterpillar Articulated Protector sold by Petzl America, print date Jul. 30, 2020.

Webpage printout from safewaze.com showing SafeWaze Rope Protector, print date Jul. 30, 2020.

Webpage printout from ropesafeusa.com showing Ropesafe Edge Protection System, copyright RopeSafe Edge Protection System 2020.

Webpage printout from rescuetech1.com showing RescueTECH Rope Guard, copyright 2003, 2004, 2005, 2006, 2007, 2008, 2009, 2010 Rescue Technology / Technical Rope Rescue Equipment.

International Search Report from co-pending PCT/US2021/072896, date mailed Mar. 18, 2022, all references cited thereon are identified above/elow in the requisite section.

Fjord Inc. "Static Rope Edge Protection" catalog, online Jan. 13, 2021 from: https://fjordinc.com/wp-content/uploads/2021/01/STREP-CATALOG-copy-justified1_03.pdf.

* cited by examiner

EDGE PROTECTOR MAT

FIELD OF THE INVENTION

The invention herein pertains to climbing accessories generally, and particularly pertains to an edge protector mat with metallic bars to reduce or prevent abrasion being imparted on a climbing rope while passing over the edge of an otherwise abrasive climbing substrate.

DESCRIPTION OF THE PRIOR ART AND OBJECTIVES OF THE INVENTION

Ropes are used for many activities including scaling cliffs and ledges, or ascending and descending from the tops of roofs, ledges, cliffs, boilers, caves, and ship hulls. Ropes are also necessary to safely perform work duties for those who work as policeman, roofers, firefighters, rescuers, window washers, and military personnel. These activities require the ropes to pass over ledges, rocks, railings, edges, walls, cliffs, and other abrasive surfaces that may cause the fibers of the rope to be gradually destroyed or abraded, particularly over time. The destruction of the rope can expose the load-bearing capabilities of the rope to risk or danger and compromise the safety of the user and/or others. In an effort to protect the ropes from abrasion and damage, it is known in the art to place an article of some sort between the rope and the adjacent structure or surface. Users of the ropes may also find it necessary to use the ropes at nighttime. For example, firefighters are often called to perform their duties in the evening times. With little to no lighting at night, it is important for rescuers and those working during the night to be provided with visibility and safety by the use of visual safety indicators.

Past inventions have provided semi-rigid molded plastic sheets that provided flexibility and have the ability to conform to the edges of buildings. Another invention, sold by Petzl America, is the P68 Set Caterpillar Articulated Protector which provides a series of roller modules that can be linked together to form a flexible chain which is then placed over the edge of a structure. The rope is then placed over the roller(s) and acts as a rope protection device. An additional rope protection device is a flexible mat made from abrasion-resistant materials that is placed between the rope and the adjacent structure. The mat can be wrapped around the rope and secured in the form of a protective sleeve, or the mat can be used in a flat configuration. Another mat invention can also be attached to the rope and repositioned along the rope by the user. The mat may include a handle for ease of carrying and to facilitate repositioning of the mat during use. The handle can also be used advantageously as a load bearing member.

The prior inventions however, are ineffective in protecting the user and rope. Specifically, plastic components are prone to consumption by virtue or abrasion or heat. Metallic components, while more resistant to abrasion and heat than plastic components, are difficult to position properly and heavy to transport, particularly when such transport occurs in a backpack carried by the user.

Thus, in view of the problems and disadvantages associated with prior art devices, the present invention was conceived and one of its objectives is to provide an edge protector mat with increased versatility and use.

It is another objective of the present invention to provide an edge protector mat that includes functionality to protect ropes from abrasion and destruction when passing over the edge of a climbing structure or substrate.

It is still another objective of the present invention to provide an edge protector mat that provides load-bearing support to a rope under load stress.

It is yet another objective of the present invention to provide an edge protector mat that incorporates one or more visual safety indicators.

It is a further objective of the present invention to provide an edge protector mat that includes one or more metallic (or other suitable material) bars to soften the bending modulus of a rope passing over the edge of a climbing structure or substrate, which presents abrasion from being passed directly to the mat in addition to preserving the structural integrity of the rope.

Various other objectives and advantages of the present invention will become apparent to those skilled in the art as a more detailed description is set forth below.

SUMMARY OF THE INVENTION

The aforesaid and other objectives are realized by providing an edge protector mat that minimizes chafe and abrasion on ropes. The edge protector mat is formed from a mat with a top surface, a bottom surface, and a number of removable members. The top surface contains a plurality of receptacles grouped into one or more pairs sized, shaped, and otherwise configured to receive opposing ends of the removable members therein. Each of the removable members define opposing ends, different ones of which are positioned within corresponding ones of the pair of the receptacles of the top surface. The removable members are configured to prevent friction from being imparted onto the mat. At least one pair of the receptacles are positioned opposite one another on the mat allowing receipt of different portions of at least one of the removable members.

DETAILED DESCRIPTION OF THE PREFERRED EMBODIMENT AND OPERATION OF THE INVENTION

Figure 1:
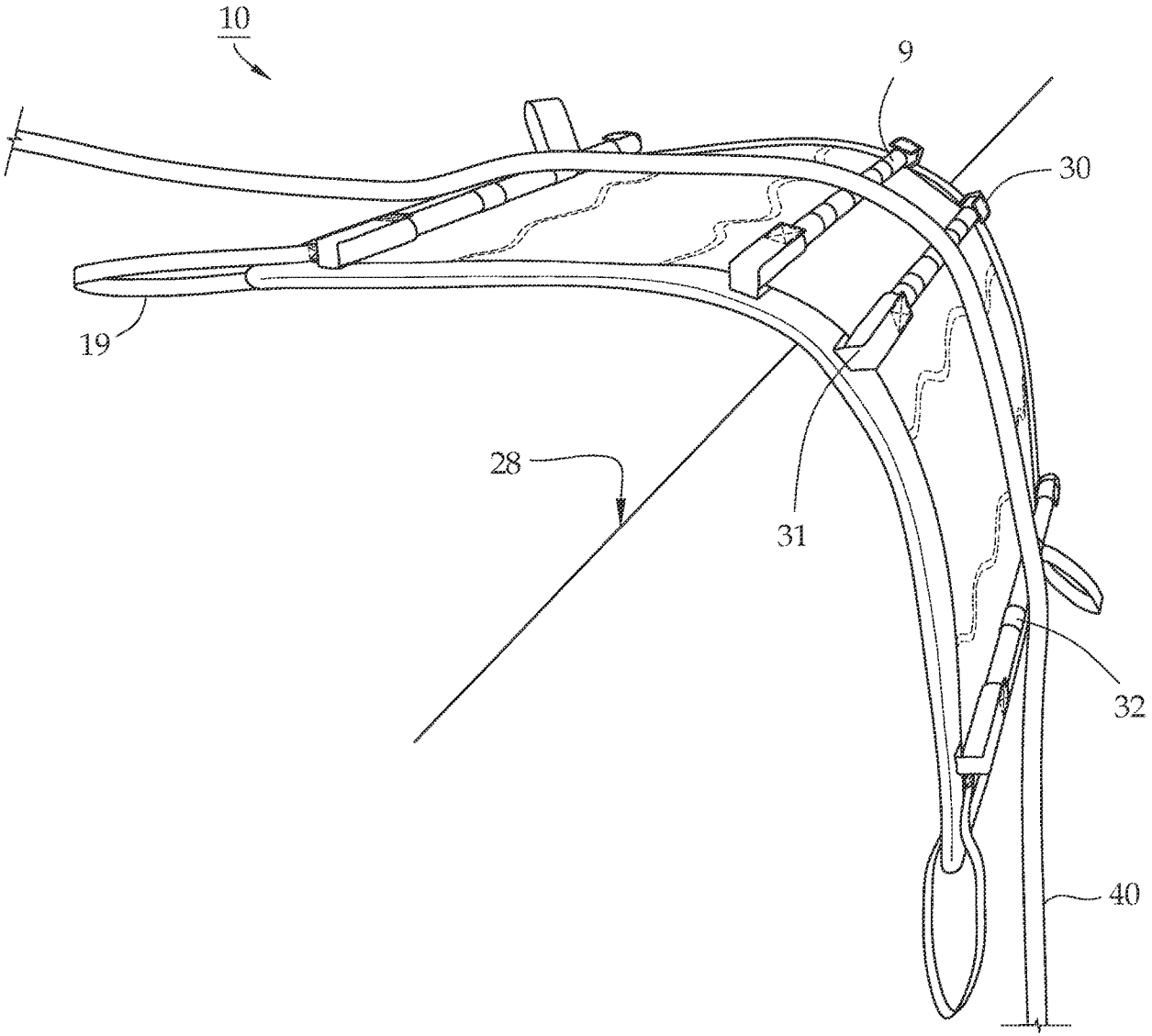
FIG. 1 shows a perspective view of an edge protector mat in an embodiment of its operating environment.

Various exemplary embodiments of the present disclosure are described below. Use of the term "exemplary" means illustrative or by way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry ad without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

For a better understanding of the invention and its operation, turning now to the drawings, FIGS. 1-8 illustrate the preferred embodiment for edge protector mat 10. Throughout the description and illustrations, edge protector mat 10 is represented as a mat designed to minimize chafe and abrasion on ropes and provides load bearing support when suspended across the ledge of a structure or building (see 28), but edge protector mat 10 is not limited to the pictured size, shape, or style, and any particular functionality should not be construed as a limitation on the instant disclosure unless specifically stated. In the preferred embodiment, edge protector mat 10 comprises a generally rectangular mat with a top surface 3, a bottom surface 5, and a number of removable member(s) 9 and may be used to soften the bend radius (also referred to as the bending modulus or flexural modulus) experienced by the rope as it folds over the edge of the building or structure 28, and/or may be deployed underneath metal climbing gear to prevent damage to the building or structure. Top surface 3 preferably defines one or more pockets, loops, or receptacles 7, ideally grouped into one or more pairs. For the purposes of this disclosure, each "pair" is considered the receptacle in laterally opposing position in view of the associated receptacle. Each of the removable members 9 define one or more portions that are preferably positioned within different ones of the one pair of the receptacles 7 of the top surface 3. The removable members 9 are configured to prevent friction from being imparted onto the mat 10 by defining a thermal and frictional "break" between the respective members and the mat surface. At least one pair of the receptacles 7 are positioned in direct laterally opposing relation to one another on the mat allowing receipt of different portions of at least one of the removable members 9. While the foregoing describes the preferred functionality of the "at least one pair of receptacles 7", nothing in this description is intended to limit the structure and operation of retaining the one or more removable member(s) 9 in connection with edge protector mat 10. For example, it is expected that insertion of the one or more removable members 9 into a single receptacle 7 or 31 (as described in further detail below) be desirable in some cases, and thus is considered within the scope of the instant disclosure.

Figure 2:
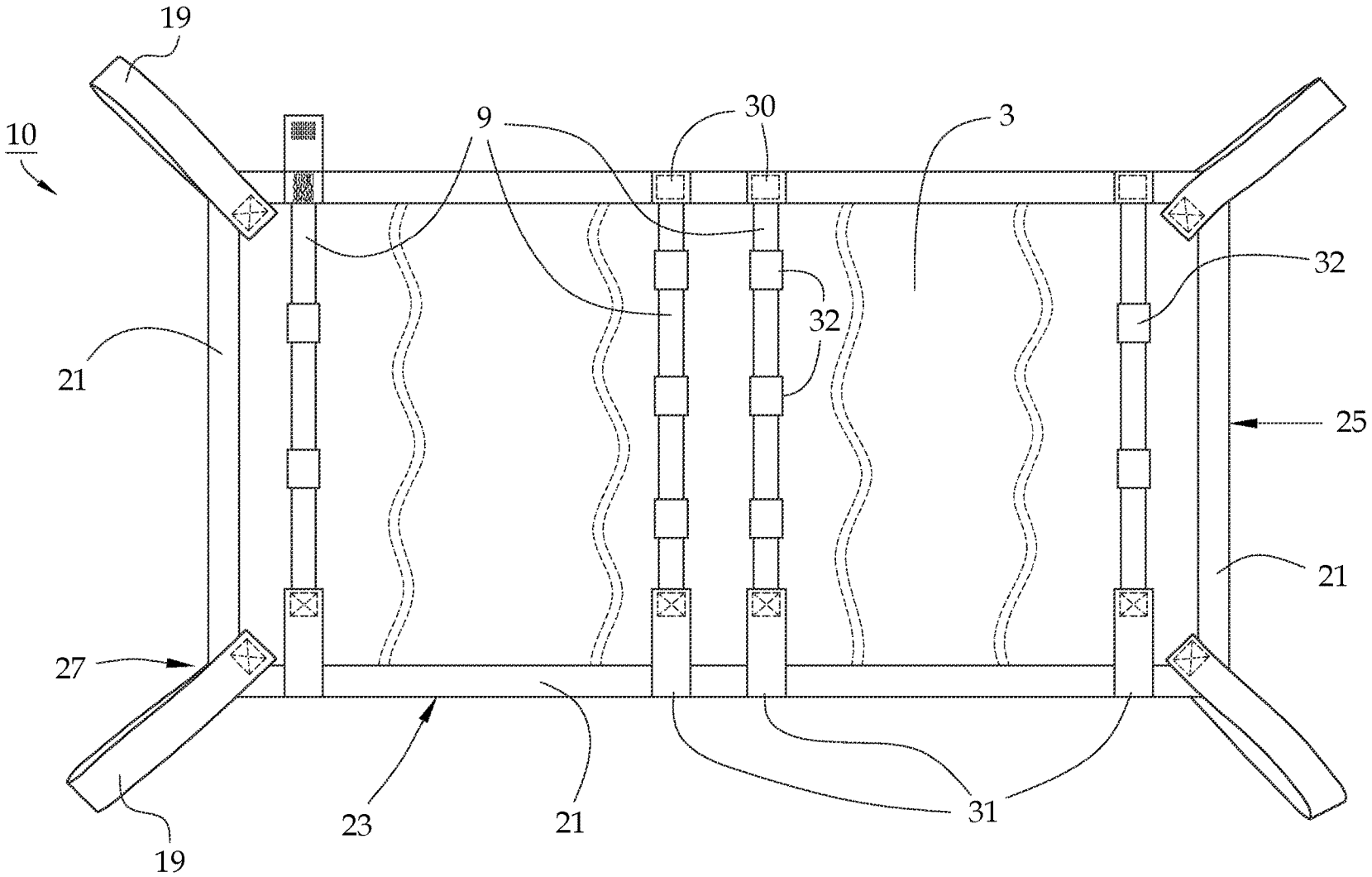
FIG. 2 pictures a top plan view of the edge protector mat of FIG. 1.
Figure 3:
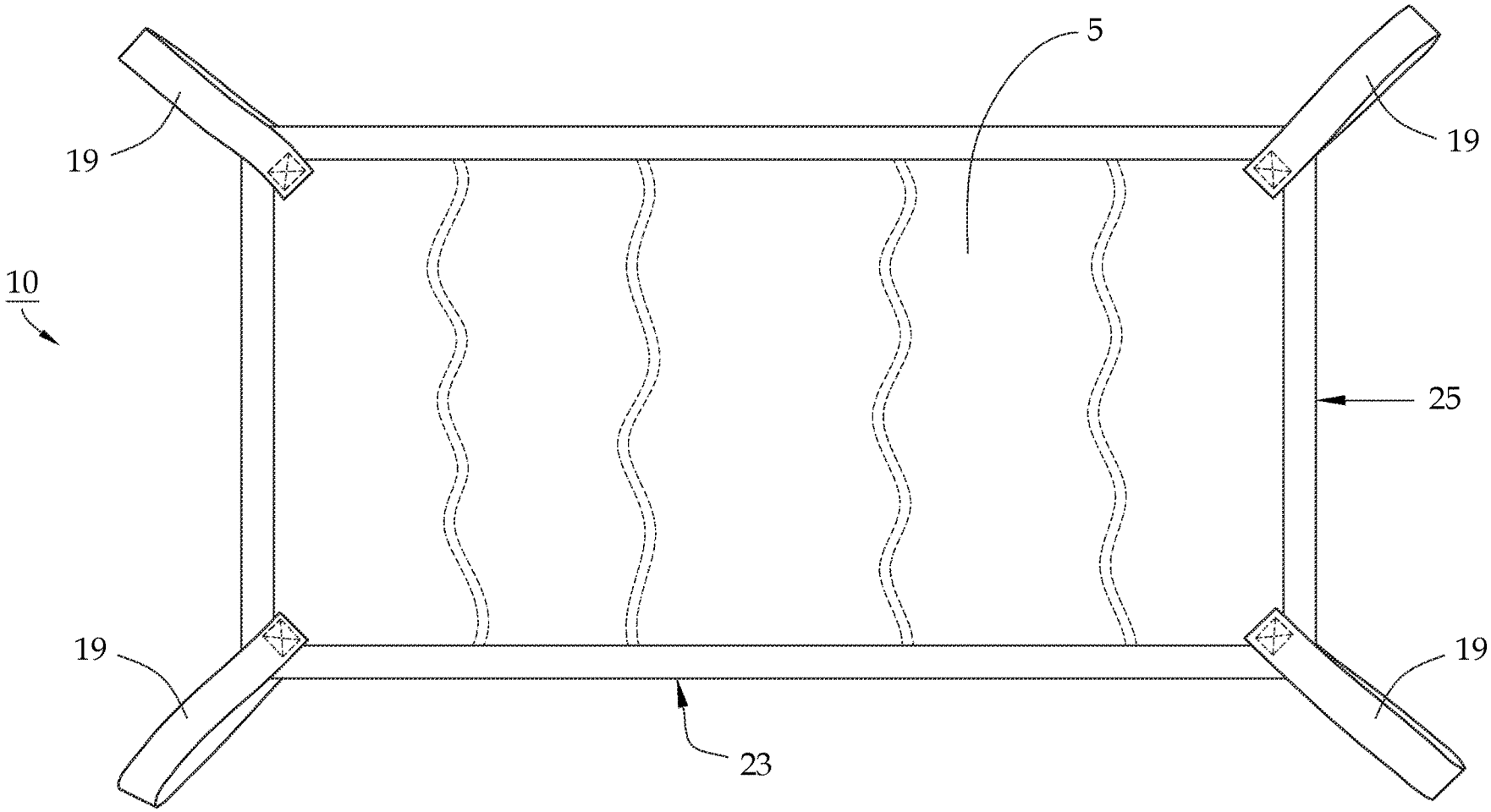
FIG. 3 depicts a bottom plan view of the edge protector mat of FIG. 1.
Figure 8:
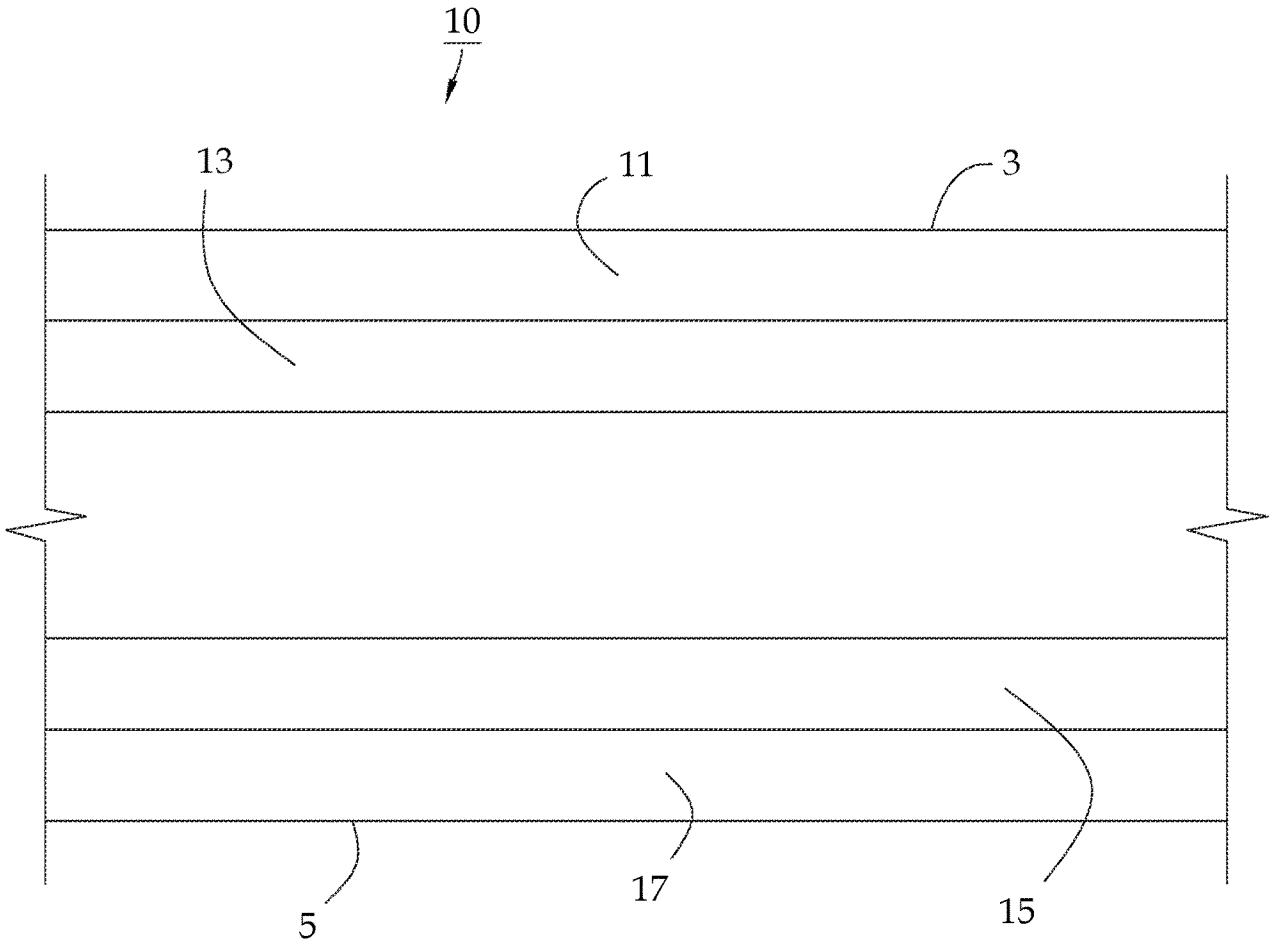
FIG. 8 is a schematic, fragmentary cross sectional view illustrating the edge protector mat multi-layer construction.

In the preferred embodiment, edge protector mat 10 is formed by a deformable, continuous web of woven material approximately a quarter (0.25) to a half (0.5) inches thick (+/−0.1 inch) and defines two longitudinal edges 23 and two lateral edges 25, such as seen in FIG. 2, forming the shape of a rectangle or square. It is ideal for edge protector mat 10 to define the shape of a rectangle having four sides, however this shape is not to be construed as a limitation of the present invention. By way of example, but not as a restraint, the size of the preferred edge protector mat 10 is longitudinally defined as approximately sixteen (16) inches (+/−1 inch) and defines a lateral measurement of approximately nine (9) inches (+/−1 inch). In one embodiment, edge protector mat 10 is formed from multiple layers of material, such as schematically seen in FIG. 8, the multiple layers defined as top layer 11, first intermediate layer 13, second intermediate layer 15, and bottom layer 17. In the preferred embodiment, the multiple layers of protector mat 10 are secured by reflective stitching to secure the multiple layers together. In an embodiment edge protector mat 10 includes a first and second material, the first material comprising a 1000 denier ballistic nylon in a high-visibility color and the second material comprising a woven black nylon weave in a herringbone pattern whereby reflective stitching secures the first material to the second material.

Preferred top layer 11 is formed from a 1000 denier nylon material due to its versatility and strength but such is not considered a limitation of the material or the instant disclosure. Preferred first intermediate layer 13 may be formed from a high loft, three-dimensional textile which is similarly not considered a limitation of the material or the instant disclosure. It is preferable for second intermediate layer 15 to be selected from a 1000 denier nylon material and/or a 1680 denier nylon material. It is also a preference for bottom layer 17 to define a herringbone nylon weave pattern with a 0.25 inch thick nylon webbing. The material used to make the bottom layer 17 is preferably a dark color, such as black, and the material used to make the first and second intermediate layers 13, 14 is preferably a high-visibility color such as yellow, orange or lime green. The term "high-visibility color" (or "hi vis" for short) in this context is taken to include all high-visibility apparel embodiments as defined by ANSI/ISEA 107-2015, including Type O, Type R, and Type P embodiment types of 20 Class 1, 2, 3, E, and Optional High-Visibility Accessory performance classes. The high color contrast between the top layer 11 and bottom layer 17 is preferred as a visual safety indicator 21 alerting the user that the top layer 11 or bottom layer 17 has worn through, exposing the high-visibility layers. Although preferred, this is not a requirement of the instant disclosure. In addition, it is preferred that intermediate layers 13, 15 be of contrasting color compared to top layer 11 and bottom layer 17 as further visual safety indicators 21.

A preferred embodiment of bottom layer 17 is provided with visual safety indicators 21 along the longitudinal and lateral edges 23, 25 as an additional visual safety indicator 21. As a further additional visual safety feature, the materials used for the top layer 11, first intermediate layer 13, second intermediate layer 15, and bottom layer 17 are preferably sewn together using reflective thread. Top surface 3 and bottom surface 5 also contain visual safety indicators 21 along the longitudinal and lateral edges 23, 25. It is ideal for the visual safety inductor 21 to be of a reflective material. An example of an acceptable reflective thread is the reflective thread offered commercially by Ki-Shin Corp. which is a 2000 denier, three filament thread with a tenacity of ~3800 cN. This, however, is not a limitation of the present invention. Tapes, appliques, and powered illumination sources may also be incorporated as desirable.

It is preferable for edge protector mat 10 to comprise visual safety indicators 21 along the longitudinal and lateral edges 23, 25 on the top surface 3 of the edge protector mat 10. In the preferred embodiment, top surface 3 defines a plurality of receptacles 7 grouped into one or more pairs. Ideally, at least one pair of the receptacles 7 are opposingly positioned on the edge protector mat 10 so as to receive different portions of at least one of the removable members 9 therein. It is ideal for the visual safety inductor 21 to be of a reflective material. It is also preferable for edge protector mat 10 to comprise a hanging loop 19 secured on each corner 27 of edge protector mat 10. Ideally, each hanging loop 19 is approximately one to two inches (2.54-5.08 cm) (+/−1 inch) in length. These hanging loops 19 can be used to secure edge protector mat 10 to a structure 28 as shown in FIG. 1, a climbing rope, or to an anchor device.

It is also seen in Figures that the top surface 3 of edge protector mat 10 includes one or more, and preferably a plurality of pairs of spaced-apart receptacles 7. These receptacles 7 are sized, shaped, and otherwise configured to receive a rigid removable member, and more preferably a member defined as a 0.5 inch thick removable metallic member 9 therein. Other members defining other lengths, diameters, and/or materials are similarly within the scope of the instant disclosure. Receptacles 7 are preferably attached to the top surface 3 by sewing, gluing, or by hook and loop but are not limited to the provided methods. At least two of the receptacles 7 are ideally located on the top surface 3 and are positioned one to two inches apart from one another. The one or more pairs of receptacles 7 are oriented into one or more rows wherein the one or more rows of receptacles 7 are laterally positioned six inches apart from one another. One or more of the plurality of receptacles 7 are defined as loop receptacles 32 by way of their shapes being in the form of a loop. Each of the removable members 9 are positioned within one pair of the receptacles 7 of the top surface 3. The removable members 9 are configured to prevent friction from being imparted onto the mat 1. At least one pair of the receptacles 7 are positioned opposite one another on the mat allowing receipt of the removable members 9. Each removable member 9 is preferably formed from a metallic material but may be formed from other materials that are resistant to the abrasive forces imparted by a rope under load. It is a preference for the longitudinal edges 23 to comprise receptacles 7 which act as fasteners enabling at least a portion of the length of the removable members 9 to be removably attached to the fastener receptacle 30. The fastener receptacles 30 are preferably individual halves of a fastening tape that when used together allow closure for ease of use, although other closing mechanisms can be utilized as are known in the art for attaching and detaching at least a portion of the opposing longitudinal edge 23 of the edge protector mat 10. Non-limiting examples of closure devices are buttons, snaps, zippers, hook and eye fasteners or magnetic fasteners. It is also ideal for the receptacles 7 which are laterally positioned between the fastener receptacles 30 to be in the shape of loops. It is preferable for one end of the removable members 9 to be inserted into one of the fastener receptacles 30 and the other end of the same removable member 9 to be inserted into a fixed receptacle 31 on the opposing side while sliding into the receptacles 7 positioned between each of the fastener receptacles 30 and fixed receptacles 31. Although shown herein comprising fastener receptacles 30 and fixed receptacles 31, as would be understood mat 10 could be formed having opposing pairs of fastener receptacles 30 along each longitudinal edge. In inserting the removable member 9 into one or more of the receptacles 7 it is ideal for the user to begin by unfastening one of the fastener receptacles 30 located on an end of the edge protector mat 10 to begin insertion of the removable member 9 therethrough. The user then inserts the removable member 9 through one or more of the loop receptacles 32 which are positioned between the fixed receptacle 31 and the fastener receptacle 30. The user continues entrance of the removable member 9 through the loop receptacles 32 until one end of the removable member 9 is fully positioned within fixed receptacle 31 and the other end of the removable member 9 is positioned within the opposing fastener receptacle 30, which may then be refastened. The removable member 9 should be securely positioned within the fixed and fastener receptacles as the removable member 9 is supported by the one or more loop receptacles 32.

Figure 4:
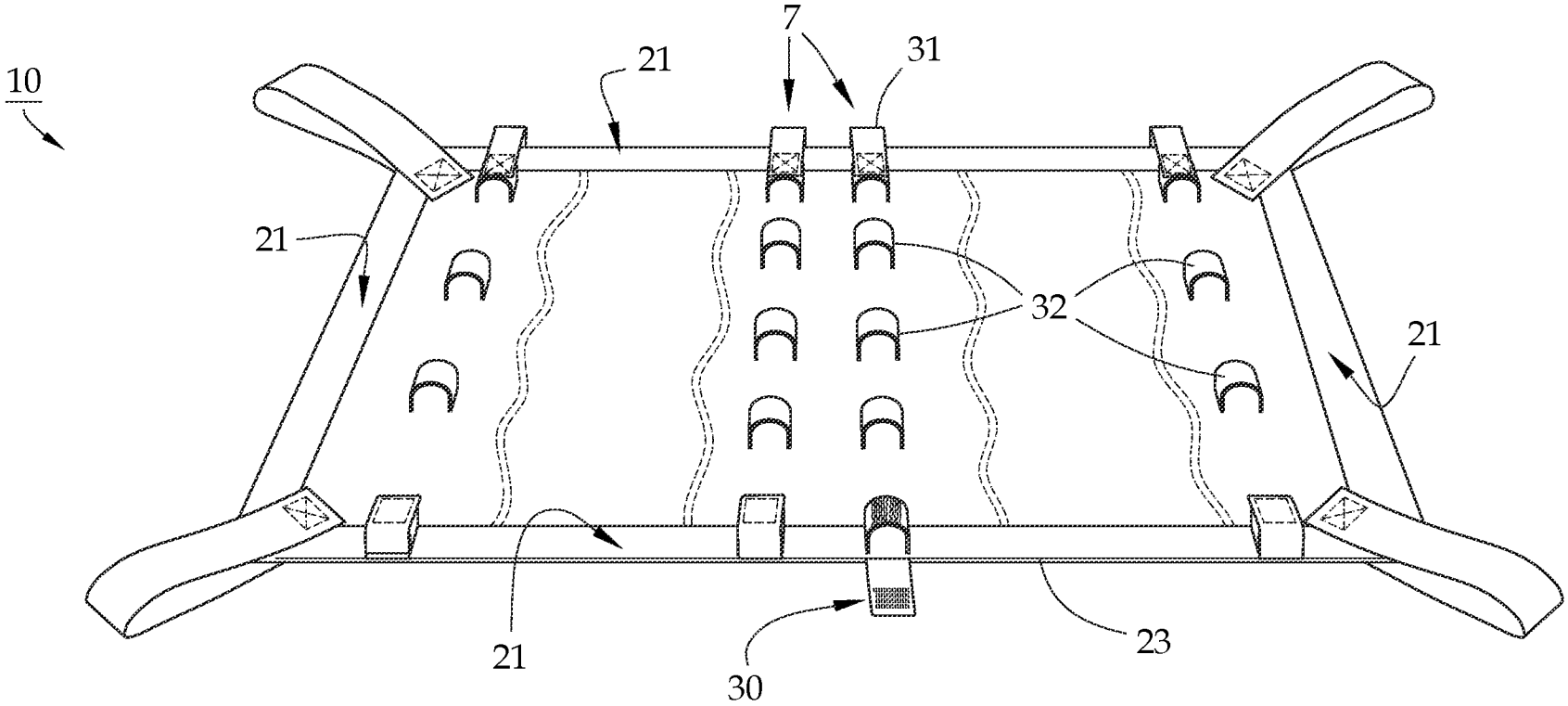
FIG. 4 demonstrates a perspective side view of the edge protector mat of FIG. 1 without the removable members.
Figure 5:
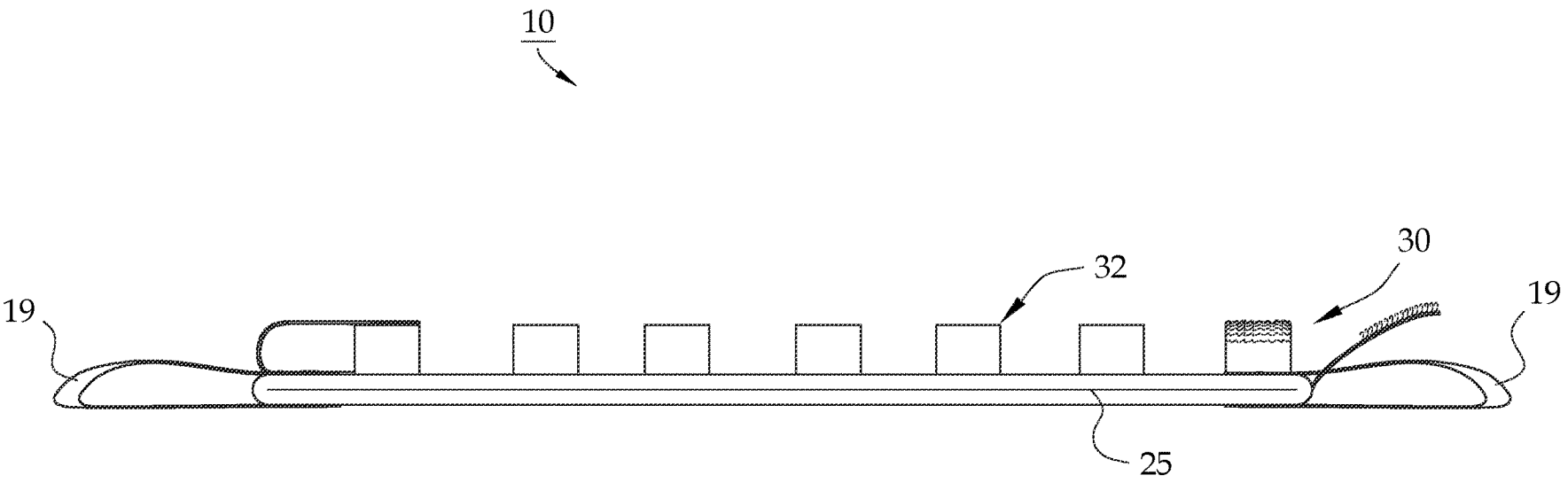
FIG. 5 illustrates an elevated end view of the edge protector mat of FIG. 4, the opposing end view being a mirror image thereof.
Figure 6:
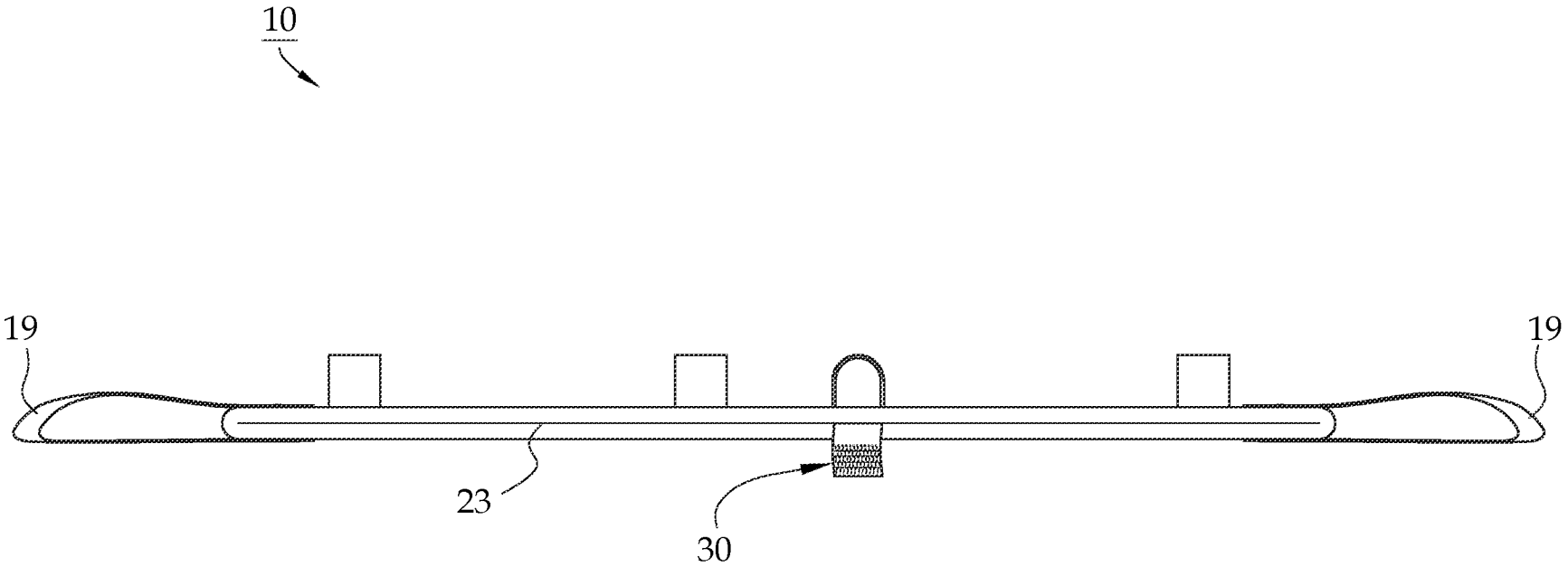
FIG. 6 shows an elevated side view of the edge protector mat of FIG. 4, the opposing side view being a mirror image thereof.
Figure 7:
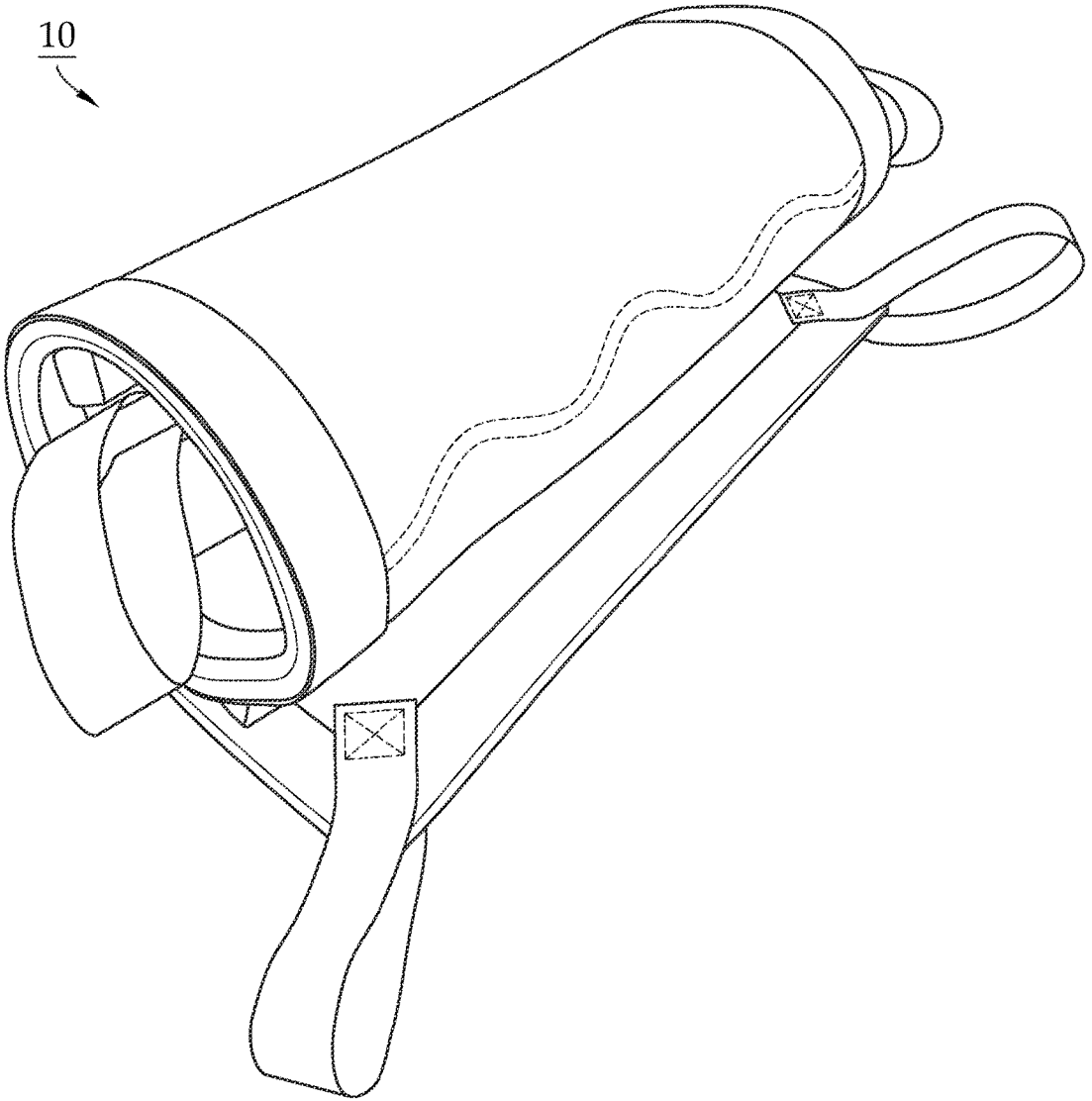
FIG. 7 features a perspective view of an edge protector mat in the rolled-up configuration.

It is preferable for the top surface 3 of the edge protector mat 10 to contain a number of removable members 9. Ideally, each removable member 9 is positioned within one pair of the receptacles 7 of the top surface 3. As would be understood one or more loops or receptacles 7 can be formed in the central or midsection of mat 10 which can be utilized for reception of removable member 9, as shown in FIG. 4, three loops 7 are available for example whereby a user can position member 9 through one, two, all three or none of the loops when mat 10 is in use, dependent on the user's preference and the task at hand. The removable members 9 are configured to prevent friction from being imparted onto edge protector mat 10. Preferably, edge protector mat 10 can be wrapped in a sleeve-like configuration (see FIG. 7) due to the flexibility of the material. The edge protector mat 10 is used to soften the bend radius of a rope as it dangles over the edge 28 of a building or structure or is used underneath metal climbing gear to prevent them from being damaged by the structure or rocks, etc.

As visual safety indicators 21, reflective trim may be used around the longitudinal and lateral edges 23, 25 (FIGS. 5-6) of the edge protector mat 10 and the layers (11, 13, 15, and 17) may be sewn together using a silver reflective thread. In addition, it is preferred that intermediate layers 13, 15 be of contrasting color compared to top and bottom layers 11, 17 as further visual safety indicators 21. The reason is that as the external layers 11, 17 begin to wear, the high contrast color will begin to telegraph through and alert the user that the protection afforded by the mat 10 has been compromised, for instance in circumstances where edge protector mat 10 experiences a high degree of friction or abrasion during a single use, or over many uses. Additionally, or in the alternative, edge protector mat 10 may qualify as fire/flame resistant under ANSI/ISEA 107-30 2015.

The illustrations and examples provided herein are for explanatory purposes and are not intended to limit the scope of the appended claims, and while specific terms have been employed, they are used in a generic and descriptive sense only. Modifications and alternatives that may suggest themselves to those skilled in the art upon reading the foregoing disclosure are intended to be considered within the scope of the invention.

The invention claimed is:

1. An edge protector mat comprising:

a mat formed from multiple layers and defining a top surface and a bottom surface, the top surface including one or more pairs of receptacles, and a loop receptacle positioned between the one or more pairs of receptacles; and one or more removable members defining opposing ends, each of the opposing ends positioned within one of the receptacles of the one or more pairs of receptacles, and a portion positioned within the loop receptacle, the one or more removable members configured to prevent friction and/or heat from being imparted onto the mat, where one or more of the multiple layers are secured by reflective stitching, wherein the top surface is a 1000 denier nylon material, wherein a first intermediate layer is a three-dimensional textile; wherein a second intermediate layer is selected from a 1000 denier nylon material and/or a 1680 denier nylon material; and wherein the bottom surface defines an herringbone nylon weave material with 0.25 inch thick nylon webbing.

2. The edge protector mat of claim 1, wherein the mat is formed from a deformable, continuous web.

3. The edge protector mat of claim 1, wherein the mat defines a shape of a rectangle including four sides and four corners.

4. The edge protector mat of claim 1, wherein the one or more removable members are defined as rods.

5. The edge protector mat of claim 4, wherein the one or more removable members are formed from a metallic material.

6. The edge protector mat of claim 1, wherein the one or more pairs of receptacles are defined as fixed receptacles and/or fastener receptacles.

7. The edge protector mat of claim 1, wherein the one or more pairs of receptacles are oriented into one or more rows of receptacles, and wherein the one or more rows of receptacles on the top surface are laterally positioned six inches apart from one another.

8. The edge protector mat of claim 7, wherein at least two of the one or more pairs of receptacles are longitudinally positioned one to two inches apart from one another.

9. The edge protector mat of claim 1, wherein the one or more pairs of receptacles are affixed to the top surface by sewing, gluing, or by hook and loop.

10. The edge protector mat of claim 1, whereby the thickness of the mat is defined as 0.25 to 0.5 of an inch.

11. The edge protector mat of claim 1, wherein the top surface further comprises a 1000 denier ballistic nylon in a hi-vis color, wherein the bottom surface further comprises a woven black nylon weave in a herringbone pattern, whereby reflective stitching secures the top surface to the bottom surface.

12. The edge protector mat of claim 1, wherein the mat further defines a hanging loop secured on each corner of the mat.

13. The edge protector mat of claim 1, wherein the mat defines longitudinal and lateral edges, wherein the mat comprises reflective strips at the longitudinal and lateral edges on the top surface of the mat.

14. An edge protector mat comprising a planar mat defined by a deformable, continuous web forming a rectangular shape having four sides and four corners, wherein the planar mat defines a pair of opposingly oriented longitudinal edges and a pair of opposingly oriented lateral edges, the planar mat formed from multiple layers and defining a top surface and a bottom surface, the top surface including one or more pairs of receptacles and a loop receptacle positioned between the one or more pairs, wherein the one or more pairs of receptacles are oriented into one or more rows and wherein the one or more rows of receptacles on the top surface are laterally positioned six inches apart from one another; and one or more removable, metallic rods, each rod positioned within one pair of the one or more pairs of receptacles and the loop receptacle of the top surface, each rod configured to prevent friction from being imparted onto the planar mat;

whereby at least one pair of the one or more pairs of receptacles are positioned in laterally opposing relation on the planar mat so as to receive different portions of at least one of the metallic rods therein; wherein the top surface is a 1000 denier nylon material, wherein a first intermediate layer is a three-dimensional textile; wherein a second intermediate layer is selected from a 1000 denier nylon material and/or a 1680 denier nylon material; and wherein the bottom surface defines an herringbone nylon weave material with 0.25 inch thick nylon webbing.

15. The edge protector mat of claim 14, wherein at least two of the receptacles of the one or more pairs of receptacles are longitudinally positioned one to two inches apart from one another.

16. The edge protector mat of claim 14, wherein the planar mat comprises one or more visual safety indicators.

17. The edge protector mat of claim 14, wherein the planar mat defines longitudinal and lateral edges, wherein the planar mat comprises reflective strips at the longitudinal and lateral edges on the top surface of the planar mat.

18. The edge protector mat of claim 14, wherein the planar mat further defines a hanging loop secured on each corner of the planar mat.

* * * * *